United States Patent [19]

Narazaki

[11] Patent Number: 5,048,880

[45] Date of Patent: Sep. 17, 1991

[54] DOOR KEY ASSEMBLY

[75] Inventor: Toshiharu Narazaki, Chiyoda, Japan

[73] Assignee: Ryobi Limited, Hiroshima, Japan

[21] Appl. No.: 535,519

[22] Filed: Jun. 11, 1990

[30] Foreign Application Priority Data

Jun. 12, 1989 [JP] Japan ..... 1-68720[U]

[51] Int. Cl.[5] ..... E05C 17/06

[52] U.S. Cl. ..... 292/262; 70/134; 292/269; 292/268

[58] Field of Search ..... 70/93, 134; 292/269, 292/262, 268, 341.15, 341.17, 277

[56] References Cited

U.S. PATENT DOCUMENTS

| | | | |
|---|---|---|---|
| 2,030,916 | 2/1936 | Gard | 292/269 |
| 2,104,172 | 1/1938 | Sibley | 292/262 |
| 4,493,500 | 1/1985 | Stroup | 292/262 |

FOREIGN PATENT DOCUMENTS

| | | | |
|---|---|---|---|
| 3402045 | 7/1985 | Fed. Rep. of Germany | 70/134 |
| 60-70166 | 5/1985 | Japan | 70/262 |
| 60-80267 | 6/1985 | Japan | 70/262 |
| 106865 | 12/1940 | Sweden | 292/262 |

*Primary Examiner*—Gary L. Smith
*Assistant Examiner*—Darnell Boucher
*Attorney, Agent, or Firm*—Oliff & Berridge

[57] ABSTRACT

It is required for a door to attach a door key assembly for the sake of caution and locking. The door key assembly to be attached to a door opposed to a door frame comprises a key body secured to an end face of the door and provided with a dead bolt and a fixing plate secured inside the door frame so as to oppose to the end face of the door. The fixing plate is provided with a vertically elongated recess having an opening facing the end face of the door and having a narrow portion and a groove formed on one side of the narrow portion. The recess and the groove are arranged vertically side by side so as to communicate with each other through a vertically elongated window portion. The key assembly further comprises a door opening angle limiting arm having one end engageable with the dead bolt and another end attached to the fixing plate, a slide pin disposed in the groove of the fixing plate to be vertically slidable in association with the movement of the door opening angle limiting arm, and a spring disposed in the groove of the fixing plate so as to urge the slide pin upward.

6 Claims, 3 Drawing Sheets

DOOR KEY ASSEMBLY

BACKGROUND OF THE INVENTION

The present invention relates to a key and, more particularly, to a door key assembly of arm type capable of adjusting an opening angle of a door to discriminate an outsider or preventing an unauthorized personnel from being invaded to achieve prevention of crimes.

In a conventional art, the applicant of this application has provided an arm type key, in which a key body provided with a dead bolt capable of projecting and retracting is secured to a door. The frame of the door has an upper end portion to which a fixing plate provided with a slide hole (guide hole) is secured. The key is provided with a door opening angle limiting arm which is provided with an engaging hole at the lower end of the arm to be engageable with the dead bolt. A movable pin (guide pin) is also provided for the arm at the upper and thereof. The door opening angle limiting arm is slidably attached to the fixing plate through a return spring in a manner that the movable pin is engaged with the slide hole of the fixing plate.

However, the door key assembly of the prior art described above provides the following defect. Namely, it is required for the guide hole arranged along the moving direction of the guide pin to have a large size in the widthwise direction of the fixing plate, so that it is difficult to attach the key to a door having a thin thickness of the door. In addition, the movement of the door opening angle limiting arm is limited to the size or location of the guide hole, so that the key may be damaged if the key is forcibly moved with the arm taken out.

With another type conventional key such as disclosed in the Japanese Utility model Paid-open Publication No. 60-70166, a door opening angle limiting arm supported to a fixing plate by a movable pin may be slid in an inclined manner in association with the movement of the arm during the door opening operation, and as the sliding resistance increases, the key may be damaged by unnatural force applied to the fixing portion of the arm when the arm is pulled outwardly. In addition, since an arm return spring and a slider are arranged to the rear side of the fixing plate, the thickness of the key itself is made unnecessarily large, resulting in the formation of the deep hole in a door frame to accommodate the same and hence, involving a troublesome working for attaching the key to the door. Moreover, it is desired to avoid the incorporation of a large return spring.

Furthermore, the keys of the prior art described above lack in the outer appearance for the provision of the slide holes.

SUMMARY OF THE INVENTION

An object of the present invention is to substantially eliminate defects or drawbacks encountered to the prior art described above and to provide a door key assembly capable of attaching to a door having thin thickness and attaining of an improved function with high strength and also capable of providing a fine outer appearance.

This and other objects can be achieved according to the present invention by providing a door key assembly to be attached to a door provided with a door frame to an end face of the door, the key assembly comprising a key body secured to an end face of the door and provided with a dead bolt, a fixing plate secured inside the door frame so as to oppose to the end face of the door, the fixing plate being provided with a vertically elongated recess and a groove formed along the recess, the recess and the groove being arranged side by side so as to communicate with each other through a vertically elongated window portion having a lateral opening, a door angle limiting arm having one end engageable with the dead bolt and another end attached to the fixing plate, a slide pin disposed in the groove of the fixing plate to be vertically slidable in association with a movement of the door opening angle limiting arm, and an elastic means disposed in the groove of the fixing plate so as to urge the slide pin upward.

According to the structure of the door key assembly of the character described, when the door is closed, the door opening angle limiting arm is forced upwardly by the urging force of the return spring and, in this state, the arm is accommodated in the recessed portion of the fixing plate in a vertical location and the engaging hole of the arm is positioned to a portion at which it is engageable with the dead bolt.

A thumb turn of the key body is rotated in the predetermined direction with the door closed to project the dead bolt in the first stage and then to engage with the engaging hole of the arm. After this operation, when the door is opened, the lower portion of the arm is pulled outwardly in a cantilever manner by the engagement with the dead bolt. The slide pin is then lowered along the groove formed in the fixing plate against the urging force of the return spring by the effective stroke. The opening of the door is once stopped at this state with a slight angle for the sake of caution to form a space through which a person can see outside of the door. When the dead bolt is secondary projected, the dead bolt penetrates through the engaging hole of the arm and engaged with an engaging hole of the fixing plate to attain the door locking function.

When the door is closed in the described manner, the slide pin is upwardly moved along the inside of the groove without being inclined and the door opening angle limiting arm is again accommodated in the groove in the vertical state.

The fixing plate may be provided with a recess having a narrow portion along which a groove is formed and the slide pin and the return spring can be accommodated in the groove, so that the fixing plate can be formed with a possibly thin width and, hence, the door key assembly can be secured to a door having a relatively thin thickness. The improved engagement of the slide pin with the groove of the fixing plate allows the slide pin to slide along the groove with the reduced sliding resistance, thus preventing the arm from being damaged by an unnatural force and hence improving the strength and durability of the key assembly.

In addition, since hole means such as elongated holes do not remarkably appear outward, a fine outer appearance can be attained.

BRIEF DESCRIPTION OF THE DRAWINGS

For a better understanding of the present invention and to show how the same is carried out into effect, reference will now be made, by way of preferred embodiment, to the accompanying drawings, in which.

DESCRIPTION OF THE PREFERRED EMBODIMENT

Figure 1:
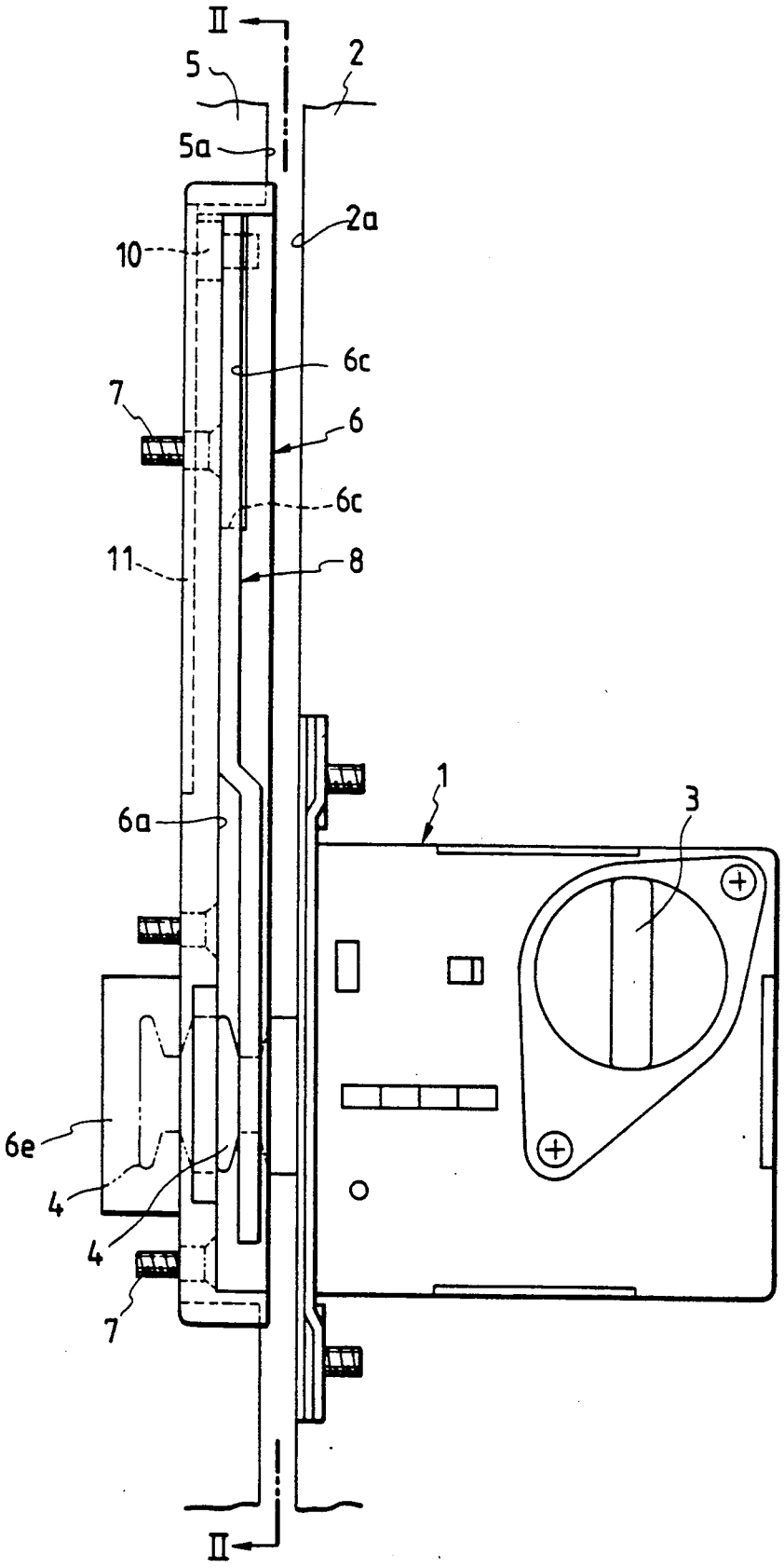
FIG. 1 is a side view of a door in closed state to which a door key assembly according to the present invention is applied.
Figure 2:
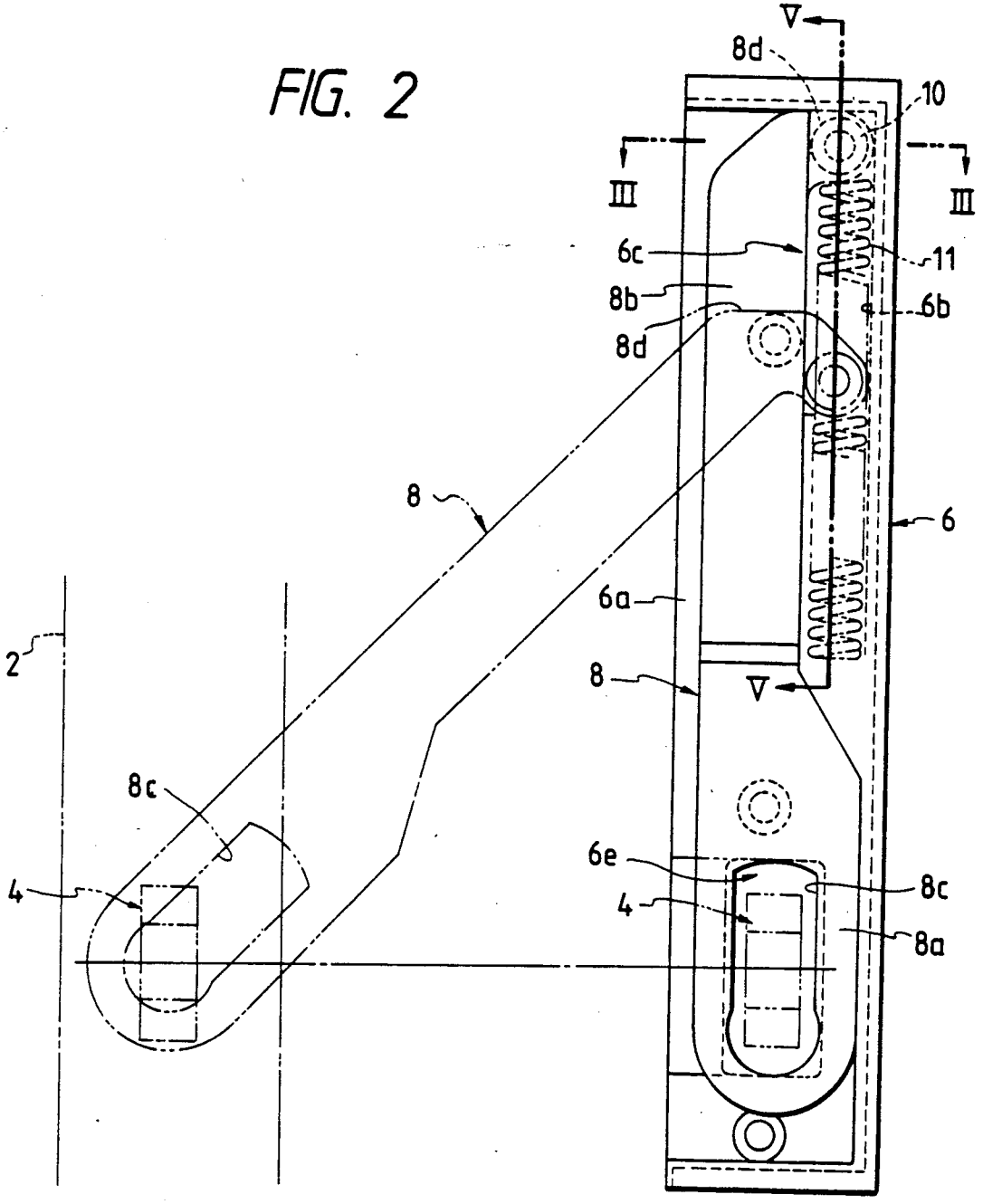
FIG. 2 is a sectional view taken along the line II—II shown in FIG. 1.

Referring to FIGS. 1 and 2, a key body 1 is embedded in and fixed to an open side end portion of a door 2. A dead bolt 4 is secured to the key body 1 on an end face 2*a* of the door 2 and adapted to project or retract from the open side edge 2*a* of the door 2 by the clockwise or counterclockwise rotation of a thumb turn 3 secured to the inside of the key body 1 in a projecting manner. The dead bolt 4 projects in two stages by the rotation of the thumb turn 3 for achieving cautioning function and locking function.

The end face 2*a* of the door 2 is opposed to a door frame. A vertically elongated fixing plate 6 is embedded on the open side surface 5*a* of the door frame 5 and is secured thereto by fixing screws 7, 7—7.

The fixing plate 6 is provided with a recess 6*a* which vertically elongates and opens to the front portion, facing the end face 2*a* of the door 2 and in which a door opening angle limiting arm 8 is accommodated as shown in FIG. 1 as a side view. As shown in FIG. 2, the door opening angle limiting arm 8 has a lower portion 8*a* having a wide width and an upper portion 8*a* having a narrow width by curring away one side thereof. In conformity with the shape of the arm 8, the recess 6*a* is also formed with an upper narrow portion and a lower wide portion.

Figure 3:
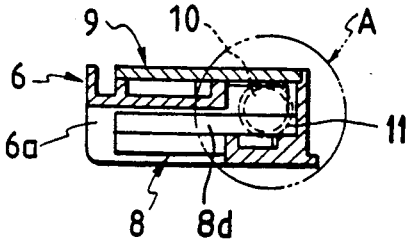
FIG. 3 is a cross sectional view taken along the line III—III shown in FIG. 2.
Figure 4:
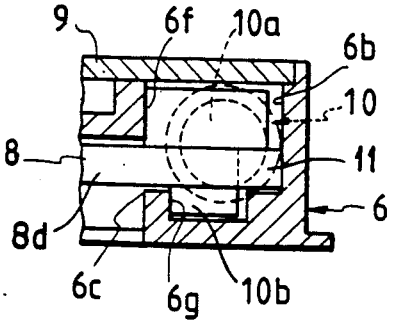
FIG. 4 is an enlarged sectional view of a portion enclosed by a circle A shown in FIG. 3.
Figure 5:
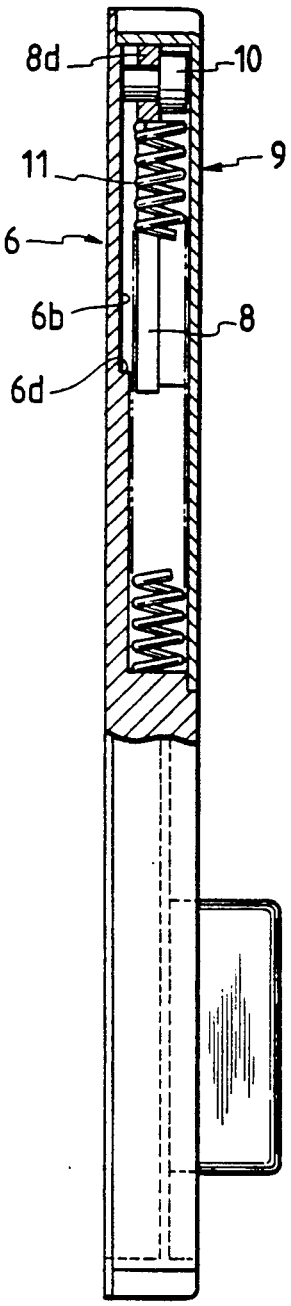
FIG. 5 is a sectional view taken along the line V—V shown in FIG. 2.

The fixing plate 6 is also provided with a vertically elongated groove 6*b* located rearwardly on the upper one side of the fixing plate 6 (FIG. 3 and 4) and disposed in a cut away portion of the arm 8. A slide pin 10 with a half portion 10*a* and a half portion 10*b* and a spring means 11 as an elastic means, both described later in detail, are accommodated in the groove 6*b*. The upper end 8*d* abuts against the upper end of the spring 11. The groove 6*b* is disposed in parallel with the recess 6*a* in the widthwise direction of the fixing plate 6 in a manner that the groove 6*b* communicates with an upper one side of the narrow portion of the recess 6*a* through a formation of a window portion 6*c* having an opening narrower than that of the groove 6*b* and being laterally arranged on one side of the fixing plate 6. As shown in FIG. 5, at a vertically intermediate portion is formed a stepped portion 6*d* against which a slide pin abuts when it reaches a lower limit of the sliding movement of the slide pin 10 as described later.

The groove 6*b* is closed by a cover 9 secured to the rear surface of the fixing plate 6 by means of screws, not shown, to thereby prevent the slide pin 10 and the spring 11 accommodated in the groove 6*b* from being removed and also prevent foreign material from sticking to the slide pin 10 and the spring 11.

The fixing plate 6 is further provided, at the lower portion thereof, with a hole 6*e* formed so as to be engaged with the dead bolt 4 when projected in two stage to thereby attain the locking function of the key.

The door opening angle limiting arm 8 is provided, at the lower end thereof, with a through hole 8*c* detachably engageable with the dead bolt 4 and provided with an upper end 8*d* bent on one side with a reduced width, i.e. bent on the side of the groove 6*b*. The slide pin 10 located in the groove 6*b* is integrally secured to the bent upper end 8*d* so as to penetrate the same rearwardly.

Figure 6:
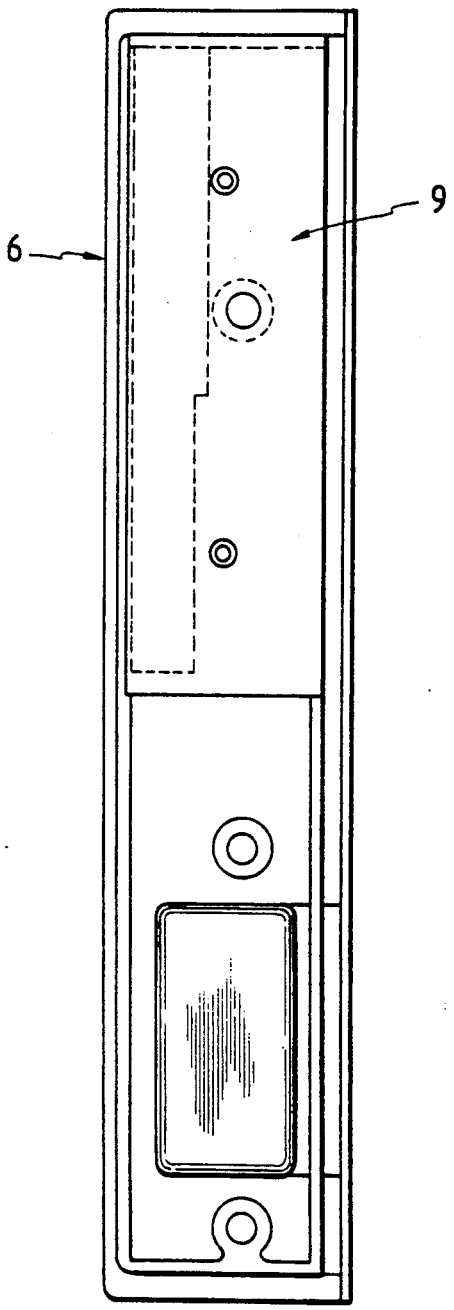
FIG. 6 is a plan view of a rear side of a fixing plate of the door key assembly shown in FIG. 1.

The upper end 8*d* of the arm 8 is inserted, in assembling the same, through the window portion 6*c* into the groove 6*b* and the slide pin 10 is then inserted through the opening thereof and secured to the upper end 8*d* of the arm 8. After this assembling process, the opened side of the groove 6*b* is closed by the cover 9 (FIG. 6).

The upper end 8*d* of the arm 8 has two pin portions 10*a*, 10*b* on both side 5 thereof so as to be slidably guided by the groove 6*b*. Accordingly, when the arm is rotated, it is moved on a plane in parallel with the end face of fixing plate 6, e.g., the cover plate 9 without inclination from the plane thereby to decrease its sliding resistance. Further, since the pivot position of the arm, that is, the upper bent portion 8*d* can be moved vertically cooperating with the spring 11, when the arm 8 is rotated, an unnatural force is not exerted on the arm 8. In addition, the arm 8 can be rotated irrespective of the height position of the upper bent portion 8*d* movable in the vertical position thereby to avoid damage even if the arm 8 is carelessly moved.

When the door 2 is opened, the dead bolt 4 is completely retracted into the key body 1 by rotating the thumb turn 3. When the door 2 is locked, the dead bolt 4 is inserted into the hole 6*e* of the door frame 5. Further, when the door 2 is slightly opened with a caution, the front end portion of the dead bolt 4 is passed through the hole 8*c*. At this time, the arm 8 is rotated in a cantilever manner while the upper end 8*d* thereof is lowered to push the spring 11 because of the engagement between the hole 8*c* and dead bolt 4 as shown in FIG. 2.

At this time, the peripheral surfaces of both the ends 10*a* and 10*b* of the slide pin 10 in the groove 6*b* abut against both the side surfaces 6*f* and 6*g* of the groove 6*b* to be slidable in a manner supported at both the ends thereof. Accordingly, the arm 8 can be attached to the fixing plate 6 to be taken out from the fixing plate 6 as shown in two dot and dash line in FIG. 2 without being removed from the window portion 6*c*. The spring 11 for returning the arm 8 to a position in the fixing plate 6 urges the slide pin 10 upwardly when the arm 8 is positioned in the fixing plate to close the door 2.

It is to be understood by persons in the skilled art that the present invention is not limited to the described preferred embodiment and many other changes and modifications may be made to the present invention without departing from the scope of the appended claims.

What is claimed is:

1. A door key assembly to be formed between a door and a door frame opposed thereto, comprising:

a key body secured to an end face of the door, said key body being provided with a dead bolt;

a fixing plate secured inside the door frame so as to oppose the end face of the door, said fixing plate being provided with a vertically elongated recess and a groove along said recess, said recess and said groove being arranged side-by-side so as to communicate with each other through a vertically elongated window portion having a lateral opening;

a door opening angle limiting arm having one and engageable with said dead bolt and another end attached to said fixing plate, said one end having a first width and said another end having a second width which is narrower than said first width, said second width being formed by a cut-away portion in said one end thereof, said groove being disposed in a cut-away portion of the fixing plate to receive an elastic means;

a slide pin disposed in said groove of the fixing plate to be vertically slidable in association with a movement of said door opening angle limiting arm; and said door opening angle limiting arm has one end bent inward of said groove and said slide pin is secured to the bent end of the door opening angle limiting arm;

said elastic means being disposed in said groove of the fixing plate so as to urge said slide pin upward.

2. A door key assembly according to claim 1, wherein said elongated recess has a narrow portion in parallel with which said groove is disposed.

3. A door key assembly according to claim 1, wherein said door opening angle limiting arm is accommodated in said recess of the fixing plate so as to be taken out therefrom with one end engaged with said dead bolt.

4. A door key assembly according to claim 1, wherein said groove is covered by a cover member.

5. A door key assembly according to claim 1, wherein said groove of the fixing plate is provided with a stepped portion at a vertically intermediate portion so that said slide pin abuts against the stepped portion when the slide pin is lowered to open said door.

6. A door key assembly according to claim 1, wherein said key assembly projects or retracts said dead bolt in two stages.

* * * * *